US006453516B1

(12) United States Patent
Kageyama

(10) Patent No.: US 6,453,516 B1
(45) Date of Patent: Sep. 24, 2002

(54) CLIP MOUNTING STRUCTURE

(75) Inventor: Hidehei Kageyama, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/803,937

(22) Filed: Mar. 13, 2001

(30) Foreign Application Priority Data

Oct. 23, 2000 (JP) ..... 2000-323220

(51) Int. Cl.[7] ..... B43K 25/02
(52) U.S. Cl. ..... 24/11 HC; 24/11 F
(58) Field of Search ..... 24/11 R, 11 F, 24/11 HC, 11 P; 401/104, 202, 242, 131

(56) References Cited

U.S. PATENT DOCUMENTS 1,465,957 A * 8/1923 Wahl
3,127,647 A * 4/1964 Helitas
3,146,758 A * 9/1964 Zepell
3,200,792 A * 8/1965 Zepell
4,608,733 A * 9/1986 Eylers
4,797,982 A * 1/1989 Eylers et al.
4,844,642 A * 7/1989 Inaba et al.
4,990,015 A * 2/1991 Perrin
5,632,565 A * 5/1997 Yamaguchi

FOREIGN PATENT DOCUMENTS

JP 11-157280 * 6/1999
JP 2000-296692 * 10/2000

* cited by examiner

*Primary Examiner*—James R. Brittain
(74) *Attorney, Agent, or Firm*—McGinn & Gibb, PLLC

(57) ABSTRACT

A clip mounting structure for providing a large amount of rocking of a clip without requiring any spring or the like, includes a clip which has a base which is inserted into a groove within a cap sleeve, a clip body which is located outside of the cap sleeve and extends substantially in parallel to an axial direction, and mainly has a surface substantially orthogonal to a radial direction, and a coupling portion which extends in the radial direction, for coupling the base to the clip body. When the clip is caused to rock by holding the clip body, an angle between the coupling portion and the base becomes larger to deform the clip. Since the coupling portion is not restricted by the cap sleeve, the coupling portion can become deformed greatly. Also, the cap sleeve prevents the coupling portion from rolling.

14 Claims, 6 Drawing Sheets

CLIP MOUNTING STRUCTURE

BACKGROUND OF THE INVENTION

1. Field of the Invention

The present invention relates to a clip mounting structure, in which a clip is mounted to an external shaft of an implement, which is adapted to be gripped by user's fingers in use, such as a writing utensil, a toilet article, and an electronic pen, and more particularly to a clip mounting structure capable of providing a large amount of rocking (e.g., tilting) of the clip.

2. Description of the Related Art

A clip mounted to an external sleeve of a writing utensil or the like is used to sandwich a shirt or jacket pocket or documents between the clip and the external sleeve when carrying the writing utensil or the like. Therefore, to reliably sandwich the pocket, etc., the external sleeve and the clip are preferably adapted to be close (e.g., urged) together at all times. On the other hand, on sandwiching the pocket, etc., a clearance between the external sleeve and the clip must be created for inserting the edge of the pocket or documents, and the clip preferably rocks largely so as to separate from the external sleeve.

However, if the clip is made of a strong material (e.g., metal), then a large amount of rocking of the clip cannot be performed in many instances. Therefore, to provide a large amount of rocking, a contrived clip, as shown in FIG. 7, has been used.

In FIG. 7, a portion of a writing instrument or the like is shown which includes an external sleeve 40, and a clip 42 having a base 42*a* to be inserted into the external sleeve 40, and a clip body 42*b* extending substantially in parallel to the external sleeve 40. The base 42*a* is inserted into the external sleeve 40 through a lateral hole formed in the side of the external sleeve 40. A threaded shaft 44*a* of a tail plug 44 is threadably mounted in an end portion of the external sleeve 40. The tip end of the threaded shaft 44*a* loosely passes though the base 42*a* so that the base 42*a* is prevented from falling off the external sleeve 40. Further, a partition wall 46 is pressed into the external sleeve 40 so as to be fixed therewithin. A spring 48 is inserted between the partition wall 46 and the base 42*a*, for pressing (urging) the base 42*a* continuously toward the end portion of the external sleeve 40.

In the clip 42 described above, when the tip end of the clip body 42*b* is raised away from the external sleeve 40 as indicated by a virtual line in FIG. 7 and the clip 42 is caused to rock (e.g., tilt or rotate) around the vicinity of the base 42*a*, the base 42*a* tilts against a spring force of the spring 48 to form a clearance between the clip body 42*b* and the external sleeve 40. Since only the spring 48 becomes deformed without substantially deforming the clip 42 itself, a large amount of rocking can be provided with a comparatively small force applied to the clip body 42*b*. Also, when the force to the clip body 42*b* is released, the spring force of the spring 48 presses the base 42*a* against the end portion of the external sleeve 40 to release the tilt configuration. Therefore, the clip body 42*b* returns to its original state in which it is close to the external sleeve 40.

However, such a conventional structure, as described above, requires the spring 48, and a large number of parts is required. Further, assembly becomes complicated, thereby increasing the cost.

SUMMARY OF THE INVENTION

In view of the foregoing and other problems, disadvantages, and drawbacks of the conventional structures, an object of the present invention is to provide a clip mounting structure capable of securing a large amount of rocking of the clip in a simple configuration.

To attain the above described and other objects, according to the prevent invention, a clip mounting structure includes a clip which is mounted to the external sleeve of an implement which is adapted to be gripped by user's fingers in use. The clip has a base, which is inserted into the external sleeve, and which extends substantially parallel to the axial direction of the external sleeve. A clip body extends substantially parallel to the axial direction of the external sleeve outside thereof. A coupling portion extends in a radial direction substantially perpendicular to the axial direction of the external sleeve so as to couple the base to the clip body. In the vicinity of the base, the base, the clip body and the coupling portion form a substantially quasi-U shaped section. On the external sleeve, there is formed a regulation portion for regulating movement of the coupling portion of the clip in a circumferential direction substantially perpendicular to both the axial direction and the radial direction.

A groove extending from the end portion of the external sleeve in the axial direction may be formed inside the external sleeve so that the base of the clip is inserted into the groove, and the tail plug for blocking an open end of the groove may be mounted to the end portion of the external sleeve.

A space portion in which a portion of the coupling portion is housed, may be formed in the external sleeve, and the regulation portion is formed by wall surfaces defining both side portions of the space portion.

The implement can be selected from the group consisting of a writing utensil, a toilet article and an electronic pen.

Movement of the base of the clip inserted into the external sleeve is restricted by the external sleeve, whereas movement of the coupling portion is regulated by the regulation portion of the external sleeve only in a circumferential direction substantially perpendicular to both in the axial direction and in the radial direction. The coupling portion can be deformed within a plane parallel to both the axial direction and the radial direction.

Therefore, when the clip is caused to rock by holding the clip body, the angle between the coupling portion and the base becomes larger so that the clip body can be rocked further from the external sleeve. The base of the clip is inserted into the external sleeve. That is, the base of the clip is located on the inner side from the peripheral surface of the external sleeve. It is possible to take a large dimension of the coupling portion for coupling the base to the clip body in the radial direction. Therefore, an amount of displacement of the clip body caused by deformation of the coupling portion is great. As a result, a large amount of rocking of the clip can be provided, without using any spring or the like and in a simple configuration. On the other hand, since the movement of the coupling portion in the circumferential direction is regulated by the regulation portion, "rolling" of the clip can be prevented.

The present disclosure relates to subject matter contained in Japanese Patent Application No.2000-323220, filed Oct. 23, 2000, which is expressly incorporated herein by reference in its entirety.

BRIEF DESCRIPTION OF THE DRAWINGS

The foregoing and other purposes, aspects and advantages will be better understood from the following detailed description of a preferred embodiment of the invention with reference to the drawings, in which.

DETAILED DESCRIPTION OF THE PREFERRED EMBODIMENT

Figure 1:
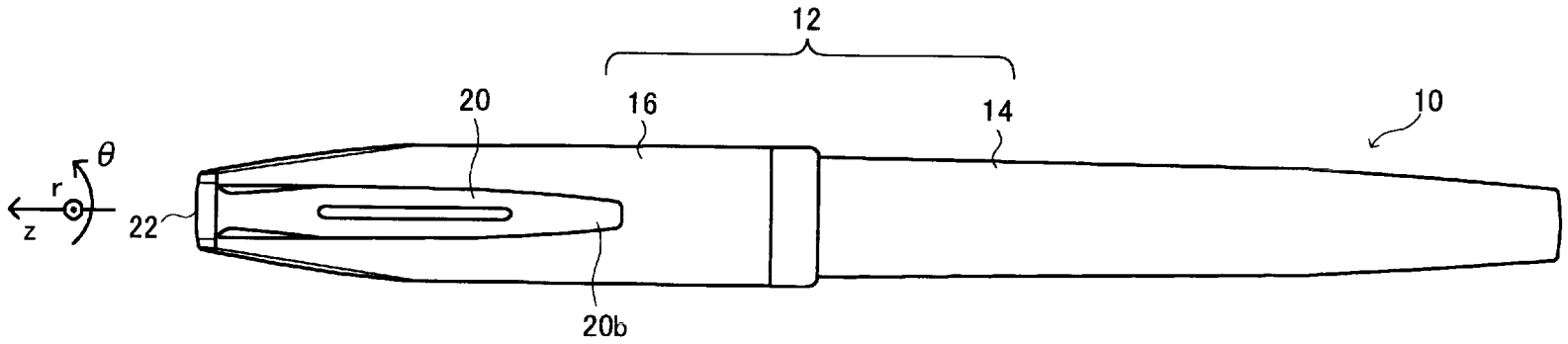
FIG. 1 is an overall plan view showing a writing utensil 10, to which a clip mounting structure according to an embodiment of the present invention is applied.

Hereinafter, with reference to FIGS. 1 to 6, description will be made of embodiment of the present invention.

In the drawings, reference numeral 10 denotes a ballpoint pen, which is a writing utensil. Of course, it is possible to apply the invention to any external sleeves of items such as toiletries or the like, as well as writing utensils such as automatic pencils, marker pens, and marking pens including ballpoint pens, and electronic pens and the like.

An external sleeve 12 of the writing utensil 10 includes a writing sleeve 14, in which a refill is contained, and a cap sleeve 16, which covers the tip end portion of the writing sleeve 14 to protect the tip end of the writing sleeve 14. The clip 20 is mounted to the cap sleeve 16, which is a part of the external sleeve 12. However, the clip 20 can be mounted to not only the cap sleeve 16, but also to any portion of the external sleeve. Also, in the example shown in FIG.1, the external sleeve, which is the cap sleeve 16, includes a plurality of parts (e.g., inner part 16A and outer part 16B). However, the external sleeve may be formed by a single part.

Hereinafter, to simplify the description, a cylindrical coordinate system will be used, and it will be assumed that an axial direction of the cap sleeve 16 is z, a radial direction which is orthogonal to the axial direction z of the cap sleeve 16, and extends from the axial direction z in a radial direction is r, and a circumferential direction which is orthogonal to the axial direction z and the radial direction r and extends around the axial direction is θ.

As shown in FIGS. 4A–4C, the clip 20 generally includes a base 20*a* which is to be inserted into the cap sleeve 16, a clip body 20*b* which is located outside of the cap sleeve 16, extends substantially parallel to the axial direction z, and mainly has a surface substantially orthogonal to the radial direction r, and a coupling portion 20*c* for coupling the base 20*a* to the clip body 20*b*. The base 20*a* extends parallel to the axial direction z of the cap sleeve 16. Therefore, the base 20*a* and the clip body 20*b* are substantially parallel to each other. The coupling portion 20*c* extends in the radial direction r, and has mainly a surface which is substantially orthogonal to the axial direction z. Thus, as shown in FIG. 4B, in the vicinity of the base of the clip 20, the base 20*a*, the clip body 20*b* and the coupling portion 20*c* form a substantially quasi-U shaped section.

Further, side portions 20*d* for forming a surface substantially orthogonal to the circumferential direction θ are extendedly formed from both side ends of the coupling portion 20*c* and the clip body 20*b*. At the tip end portion of the clip body 20*b*, an approach portion 20*e* is formed for selectively contacting the outer peripheral surface of the cap sleeve 16.

On the inner side of the cap sleeve 16, as shown in FIGS. 5A–5C, inwardly in the radial direction r from the peripheral surface thereof, a groove 16*a* is formed for extending in the axial direction z from the end portion. A space portion 16*b* is formed adjacent to the groove 16*a*, externally thereof in the radial direction r from the groove 16*a*. The space portion 16*b* is formed as a concave portion obtained by cutting off from the end portion of the cap sleeve 16 over its peripheral surface. The base 20*a* of the clip 20 is inserted into the groove 16*a*. Within the space portion 16*b*, there are housed a portion of the coupling portion 20*c* and portions of the side portions 20*d*. Wall surfaces 16*c* and 16*c* (e.g., see FIGS. 5A and 5C) defining both side portions of the space portion 16*b* function as a regulation portion for regulating rolling of the coupling portion 20*c* and the side portions 20*d* as described below.

Also, in the cap sleeve 16, a center hole 16*d* extends in the axial direction z from the end portion in its center line.

Figure 6:
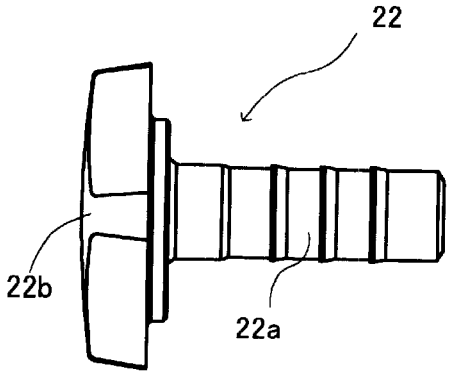
FIG. 6 is a side view showing a tail plug 22.
Figure 7:
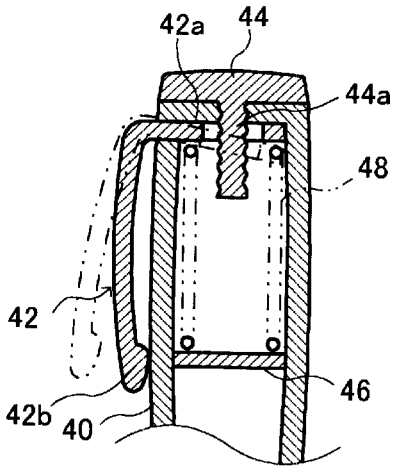
Fig.7 PRIOR ART
FIG. 7 is a longitudinal sectional view showing a conventional clip mounting structure.

A tail plug 22 is mounted at the end portion of the cap sleeve 16. The tail plug 22 has a leg portion 22*a* and a plug portion 22*b*, as shown in FIG. 6. On the peripheral surface of the leg portion 22*a*, a plurality of projections (unreferenced) are formed. The leg portion 22*a* is press-fitted into the center hole 16*d* of the cap sleeve 16. At the same time, the plug portion 22*b* of the tail plug 22 covers the end portion of the cap sleeve 16. Since the plug portion 22*b* blocks the open ends of the groove 16*a* and the space portion 16*b*, the base 20*a* of the clip 20 is prevented from slipping out from the groove 16*a*, thereby preventing the clip 20 from falling off from the cap sleeve 16.

Also, the base 20*a* of the clip 20 does not extend in a straight line in the axial direction z in a natural state before assembly, as shown in FIGS. 4A and 4B. Instead, the base 20*a* is slightly curved, and further its end surfaces on both sides are saw-tooth-shaped, as shown in FIG. 4C. Thus, when the clip 20 is inserted into the groove 16*a* of the cap sleeve 16, the clip 20 is engaged in the groove 16*a*. Therefore, the clip 20 is securely attached and is prevented from easily falling off from the groove 16*a*.

Figure 3:
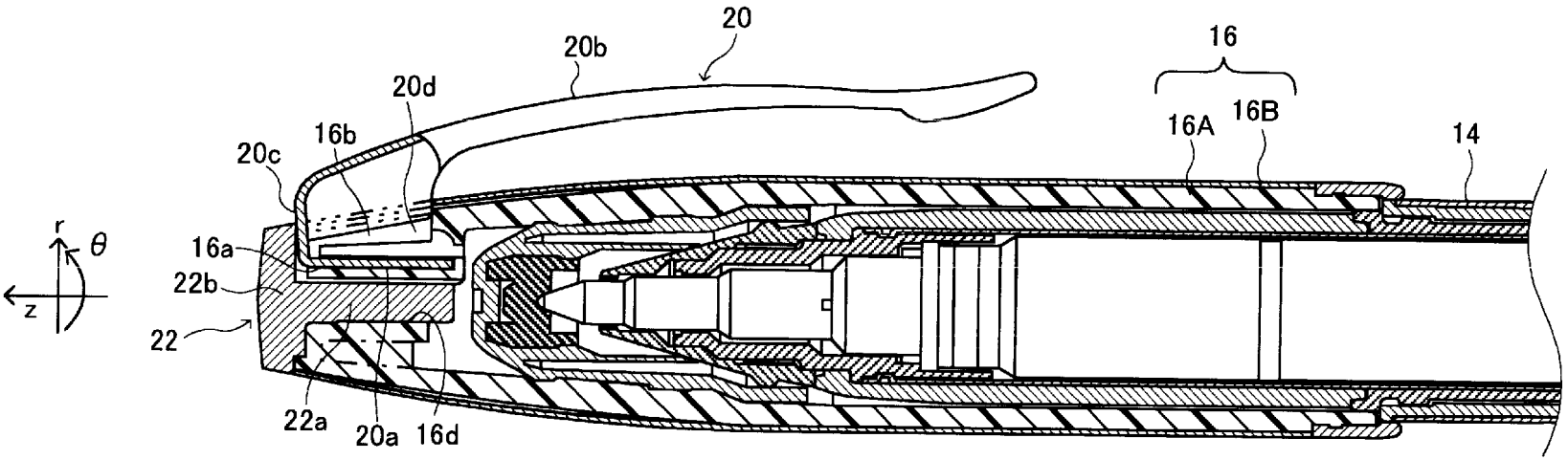
FIG. 3 is a longitudinal sectional view showing a state in which a clip 20 of FIG. 2 is caused to rock.
Figure 4:
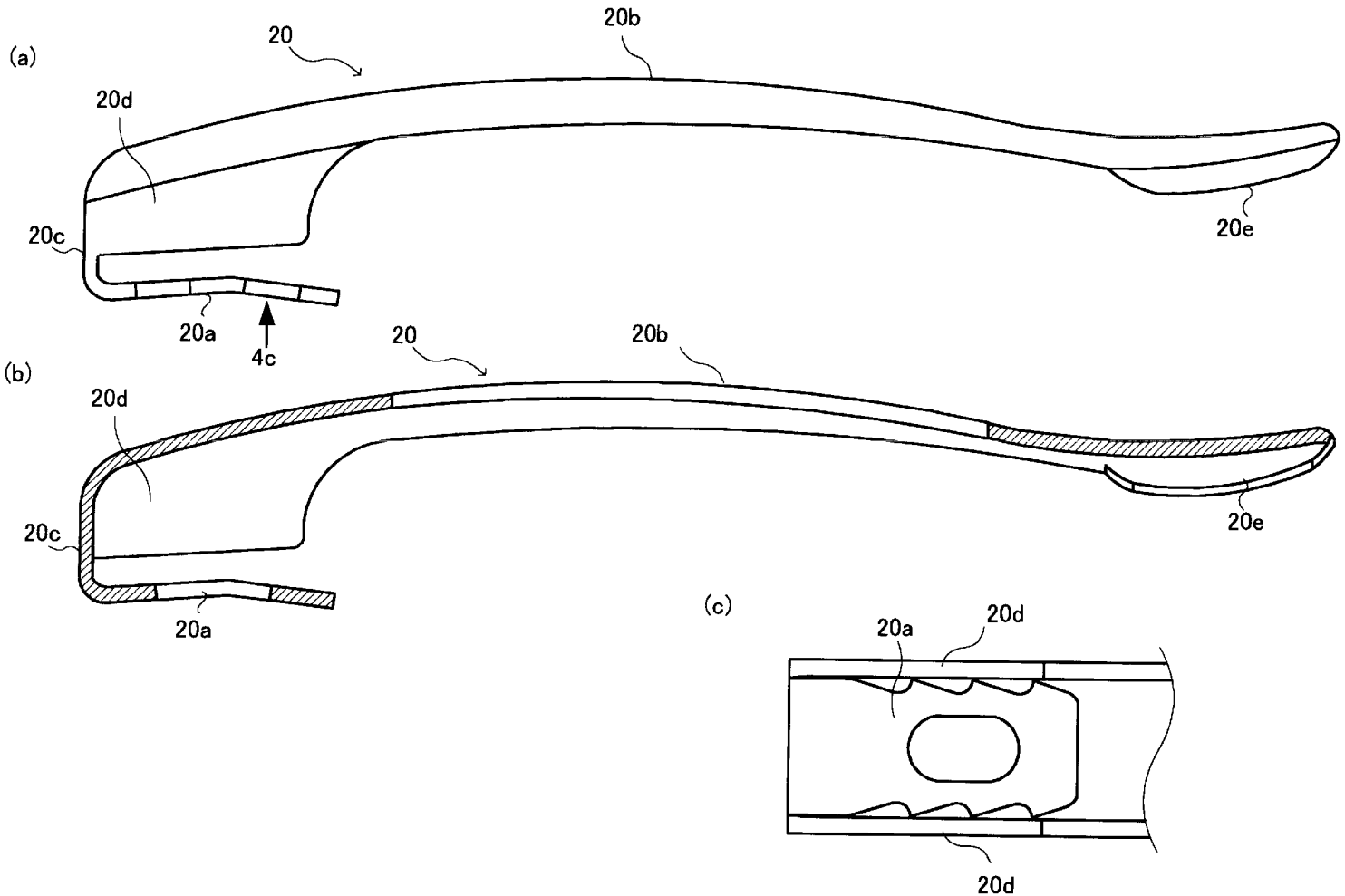
FIG. 4A is a side view showing the clip 20.
FIG. 4B is a longitudinal sectional view of the clip 20 and FIG. 4C is a schematic view of the clip 20 from an arrow 4*c* of FIG. 4A.
Figure 5:
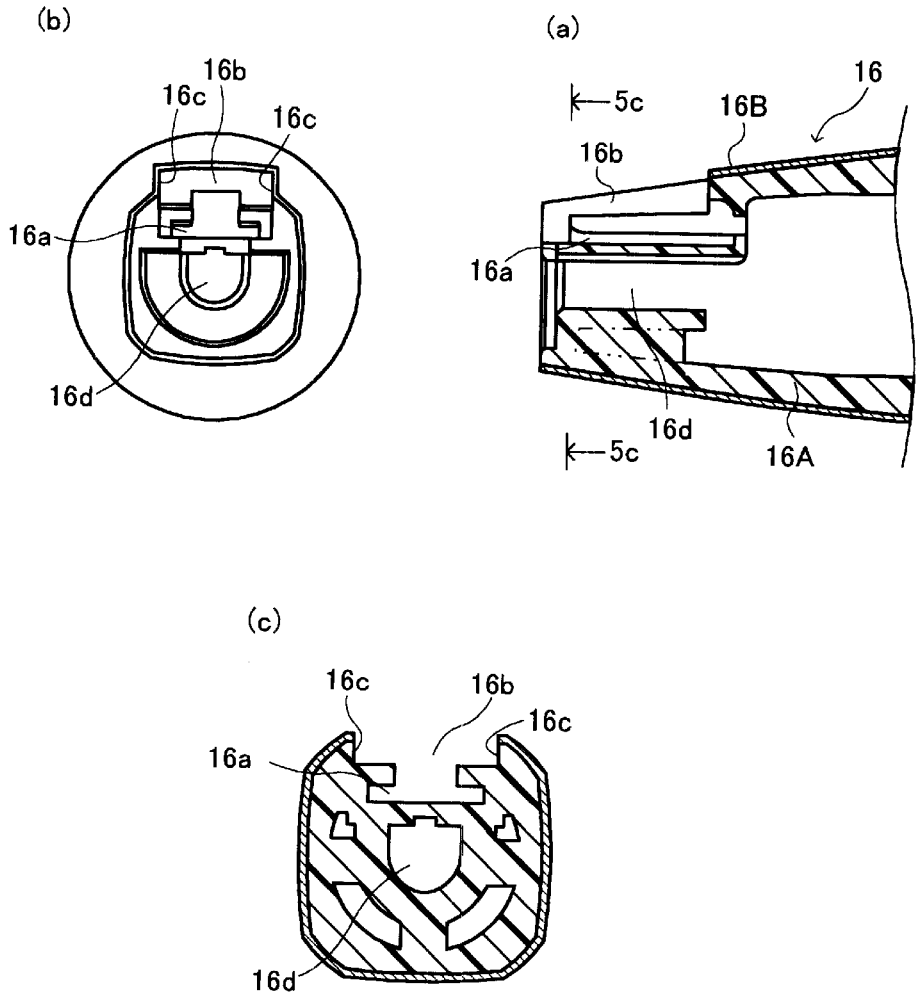
FIG. 5A is a longitudinal sectional view showing the vicinity of an end portion of a cap sleeve 16.
FIG. 5B is a view of the cap sleeve 16 from the end portion of FIG. 5A.
FIG. 5C is a sectional view of the cap sleeve 16 viewed along a line 5*c*—5*c* of FIG. 5A.

In the clip mounting structure as described above, when the clip 20 is caused to rock by holding the clip body 20*b* to sandwich the edge of a shirt or jacket pocket or documents between the clip 20 and the cap sleeve 16, the clip 20 becomes deformed such that an angle between the coupling portion 20*c* and the base 20*a* becomes larger than nearly 90°, as shown in FIG. 3. Therefore, the clip body 20*b* can rock away from the cap sleeve 16.

Thus, in the clip mounting structure of the present invention, a larger amount of rocking of the clip 20 can be secured for a number of reasons, as compared with the conventional clip mounting structure.

Figure 2:
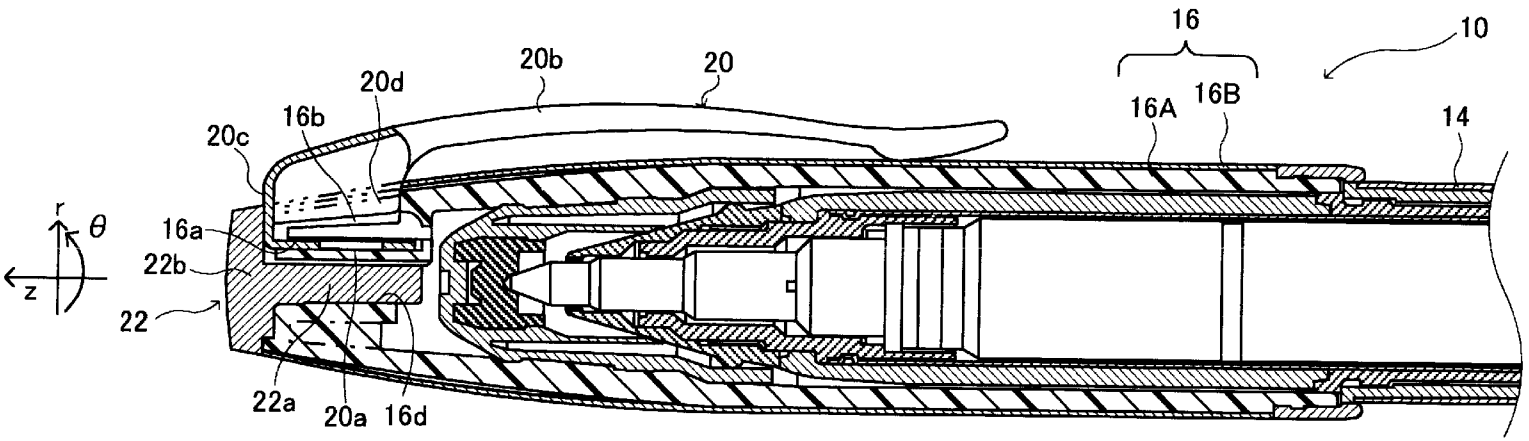
FIG. 2 is a longitudinal sectional view showing the clip mounting structure of FIG. 1.

First, even though the coupling portion 20*c* is restrained by the tail plug 22 since a portion of the coupling portion 20*c* is overlapped with the plug portion 22*b* of the tail plug 22, other portions are not restrained at all in an r-z plane parallel with the sheet of paper on which FIG. 2 is drawn. Therefore, the clip 20 can be deformed greatly.

Secondly, a dimension of the coupling portion 20*c* in the radial direction r can be made comparatively large.

More specifically, in the conventional design in which the base of the clip is not inserted into the external sleeve, but is arranged on an outer peripheral surface of a main body portion of the external sleeve or is arranged at a projecting location from the outer peripheral surface of the main body portion of the external sleeve in the radial direction, when the dimension of the coupling portion in the radial direction is large, the entire clip projects greatly in the radial direction, which would be an undesirable design.

In the present embodiment, however, the base 20*a* of the clip 20 is arranged inwardly of the outer peripheral surface of the main body portion of the cap sleeve 16. Therefore, the dimension of the coupling portion 20*c* in the radial direction r can be made large, and thus the clip body 20*b* coupled to the coupling portion 20*c* can be displaced greatly.

As described in the first reason, the coupling portion 20*c* of the clip 20 is not regulated (e.g., restricted) in the r-z plane, but in the θ-z plane parallel with the sheet of paper on which FIG. 1 is drawn, the coupling portion 20*c* and the side portions 20*d* are regulated by wall surfaces 16*c* and 16*c* defining both side portions of the space portion 16*b*. Therefore, the clip 20 is not allowed to move in the θ direction, or to rotate around the r-axis. Thus, the "rolling" of the clip 20 can be prevented.

If the force from the clip 20 is released, a resilient force, which the clip 20 itself has, returns the clip 20 to its original state, and the approach portion 20*e* located at the tip end portion of the clip body 20*b* approaches the cap sleeve 16. Thus, the edge of the pocket, documents or the like may be sandwiched between the approach portion 20*e* and the cap sleeve 16.

Thus, as described above, according to the present invention, a large amount of rocking of the clip 20 can be provided without requiring any additional component A such as a spring or the like, and in a very simple configuration.

While the invention has been described in terms of several preferred embodiments, those skilled in the art will recognize that the invention can be practiced with modification within the spirit and scope of the appended claims.

What is claimed is:

1. A clip mounting structure for an external sleeve of an implement which is adapted to be gripped by a user's fingers in use, comprising:

a clip, wherein said clip includes:

a base, which is inserted into said external sleeve, and which extends substantially parallel to an axial direction of said external sleeve;

a clip body which extends substantially parallel to the axial direction of said external sleeve outside of said external sleeve;

a coupling portion which extends in a radial direction substantially perpendicular to the axial direction of said external sleeve so as to couple said base to said clip body, wherein in a vicinity of said base, said base, said clip body and said coupling portion integrally form a substantially quasi-U shaped section; and side portions for forming a surface substantially orthogonal to a circumferential direction perpendicular to both the axial direction and the radial direction, formed between a side end of the coupling portion and a side end of the clip body, said external sleeve including:

a groove, into which said base of said clip is inserted, extending from an end portion of said external sleeve in the axial direction within the external sleeve; and wall surfaces defining a space portion, in which a part of said coupling portion and a part of said side portions are housed, for regulating a movement of said coupling portion of the clip in the circumferential direction, said space portion being formed adjacent to said groove, externally thereof in the radial direction from the groove and formed as a concave portion obtained by cutting off from the end portion of the external sleeve over its peripheral surface.

2. The clip mounting structure according to claim 1, further comprising:

a tail plug, mounted to an end portion of said external sleeve, for blocking an open end of said groove.

3. The clip mounting structure according to claim 2, wherein said tail plug covers an end portion of said external sleeve.

4. The clip mounting structure according to claim 1, wherein said implement is selected from the group consisting of a writing utensil, a toilet article, and an electronic pen.

5. The clip mounting structure according to claim 1, wherein said base comprises a curved structure which becomes linear when inserted into said groove.

6. The clip mounting structure according to claim 5, wherein an end of said base comprises a saw-tooth-shape.

7. A clip mounting structure, comprising:

a clip including a base which is inserted into a groove within a cap sleeve;

a clip body located outside of the cap sleeve and extending substantially in parallel to an axial direction, and having a surface substantially orthogonal to a radial direction;

a coupling portion extending in the radial direction, for integrally coupling the base to the clip body;

side portions for forming a surface substantially orthogonal to a circumferential direction perpendicular to both the axial direction and the radial direction, formed between a side end of the coupling portion and a side end of the clip body, said cap sleeve including:

a groove, into which said base of said clip is inserted, extending from an end portion of said cap sleeve in the axial direction within the cap sleeve; and wall surfaces defining a space portion, in which a part of said coupling portion and a part of said side portions are housed, for regulating a movement of said coupling portion of the clip in the circumferential direction, said space portion being formed adjacent to said groove, externally thereof in the radial direction from the groove and formed as a concave portion obtained by cutting off from the end portion of the cap sleeve over its peripheral surface.

8. The clip mounting structure of claim 7, wherein when the clip is caused to rock by holding the clip body, an angle between the coupling portion and the base increases to deform the clip.

9. The clip mounting structure of claim 7, wherein an increase in an angle between the coupling portion and the base is unrestricted by the cap sleeve.

10. The clip mounting structure of claim 7, wherein the cap sleeve prevents the coupling portion from rolling.

11. A writing instrument, comprising:

a clip including a base which is inserted into a groove within a cap sleeve;

a clip body located outside of the cap sleeve and extending substantially in parallel to an axial direction, and having a surface substantially orthogonal to a radial direction;

a coupling portion extending in the radial direction, for coupling the base to the clip body; and side portions for forming a surface substantially orthogonal to a circumferential direction perpendicular to both the axial direction and the radial direction, formed between a side end of the coupling portion and a side end of the clip body, said cap sleeve including:

a groove, into which said base of said clip is inserted, extending from an end portion of said cap sleeve in the axial direction within the cap sleeve; and wall surfaces defining a space portion, in which a part of said coupling portion and a part of said side portions are housed, for regulating a movement of said coupling portion of the clip in the circumferential direction, said space portion being formed adjacent to said groove, externally thereof in the radial direction from the groove and formed as a concave portion obtained by cutting off from the end portion of the cap sleeve over its peripheral surface.

12. The writing instrument of claim 11, wherein when the clip is caused to rock by holding the clip body, an angle between the coupling portion and the base increases to deform the clip.

13. The clip mounting structure of claim 11, wherein an increase in an angle between the coupling portion and the base is unrestricted by the cap sleeve.

14. The writing instrument of claim 11, wherein the cap sleeve prevents the coupling portion from rolling.

* * * * *